US009480904B2

(12) United States Patent
McGuffie

(10) Patent No.: US 9,480,904 B2
(45) Date of Patent: Nov. 1, 2016

(54) LINE MARKING APPARATUS

(71) Applicant: DIGITAL LINE MARKERS FZE, Sharjah (AE)

(72) Inventor: Iain Peter McGuffie, Bromyard (GB)

( * ) Notice: Subject to any disclaimer, the term of this patent is extended or adjusted under 35 U.S.C. 154(b) by 0 days.

(21) Appl. No.: 14/392,024

(22) PCT Filed: Aug. 31, 2013

(86) PCT No.: PCT/IB2013/058192
§ 371 (c)(1),
(2) Date: Mar. 3, 2015

(87) PCT Pub. No.: WO2014/037864
PCT Pub. Date: Mar. 13, 2014

(65) Prior Publication Data

US 2015/0190705 A1 Jul. 9, 2015

(30) Foreign Application Priority Data

Sep. 4, 2012 (GB) ..... 1215764.0

(51) Int. Cl.
*A63C 19/08* (2006.01)
*A63C 19/06* (2006.01)
*E01C 23/22* (2006.01)

(52) U.S. Cl.
CPC ..... *A63C 19/08* (2013.01); *A63C 19/065* (2013.01); *E01C 23/22* (2013.01); *A63C 2019/067* (2013.01)

(58) Field of Classification Search
CPC ..... A63C 19/08; A63C 19/065; A63C 2019/067; E01C 23/22
USPC ..... 222/527, 529, 530, 608, 185.1, 181.2
See application file for complete search history.

(56) References Cited

U.S. PATENT DOCUMENTS

| | | | | | |
|---|---|---|---|---|---|
| 2,812,211 | A * | 11/1957 | Gardner | A63C 19/08 | 239/150 |
| 3,796,353 | A * | 3/1974 | Smrt | A61C 19/08 | 222/609 |
| 4,262,821 | A * | 4/1981 | Smrt | B65D 83/203 | 118/305 |
| 4,524,912 | A * | 6/1985 | Jones | A01M 7/0046 | 239/150 |
| 7,163,353 | B2 * | 1/2007 | Ramirez | E01C 23/227 | 239/150 |
| 2009/0205566 | A1 * | 8/2009 | McGuffie | A63C 19/08 | 118/664 |
| 2010/0282772 | A1 | 11/2010 | Ionidis | | |

FOREIGN PATENT DOCUMENTS

| | | | | |
|---|---|---|---|---|
| DE | 3733911 A1 | 4/1989 | | |
| DE | 20 2007 006 669 U1 | 9/2007 | | |
| GB | 2129758 A * | 5/1984 | | B65D 73/0014 |
| WO | WO 9909256 | 2/1999 | | |

* cited by examiner

*Primary Examiner* — Donnell Long
(74) *Attorney, Agent, or Firm* — Timothy Marc Shropshire; Garrett James O'Sullivan; MU Patents

(57) ABSTRACT

A line marking apparatus incorporates a replaceable container (31) of line marking material. The apparatus comprises a body (3) including an opening provided with a first engaging member (21), and a replaceable container (31) for line marking material. The container comprises a base (33) and side walls (35) and is provided with an outlet (37) for the line marking material at a location remote from the base. The container is also provided in the region of the base with a second engaging member (49) adapted to co-operate with the first engaging member of the body for releasably suspending the container within the body in an inverted configuration.

20 Claims, 3 Drawing Sheets

LINE MARKING APPARATUS

FIELD OF THE INVENTION

This invention relates to line marking apparatus incorporating a replaceable container of line marking material.

DESCRIPTION OF PRIOR ART

It is known, for example from WO9909256 to provide line marking apparatus with a compartment for receiving line marking material to be dispensed. The problem associated with this arrangement, though, is that it is necessary to replenish the line marking material on a regular basis, which means that line marking material needs to be poured into the receiving compartment from a separate container. This can give rise to spillage and cause unnecessary marks on a surface to be marked and/or on the line marking apparatus itself. Also, the line marking material tends to dry onto the walls of the receiving compartment and dried flakes can subsequently fall into the material and cause blockages and inconsistencies in marking. Alternatively, it is known to provide line marking material in a replaceable container which is inserted into the receiving compartment. In this case, a tube for withdrawing line marking material from the container is inserted into an opening at the top of the replaceable container in order to draw the line marking material out of the replaceable container.

In the case of this arrangement, it is difficult to position the tube such that all the line marking material is removed from the replaceable container.

OBJECT OF THE INVENTION

It is therefore an object of the present invention to provide a line marking apparatus incorporating a replaceable container of line marking material and which overcomes, or at least ameliorates, the above disadvantages.

SUMMARY OF THE INVENTION

According to the present invention there is provided a line marking apparatus incorporating a replaceable container of line marking material, the apparatus comprising:

a body including an opening provided with a first engaging member; and a replaceable container for line marking material, the container comprising a base and side walls, the container being provided with an outlet for the line marking material at a location remote from the base, wherein the container is provided in the region of the base with a second engaging member adapted to co-operate with the first engaging member of the body for releasably suspending the container within the body in an inverted configuration.

The body may be formed with an outwardly protruding rim which is externally threaded and provided with a removable cover.

A hollow member may be attached within the rim so as to extend into the body. The hollow member may be substantially cylindrical.

The first engaging member may comprise a plurality of, for example two diametrically opposed, protrusions which extend radially inwardly from the body, for example the rim, and in particular from the hollow member.

The protrusions may be formed on members which may be slotted into recesses formed in the hollow member. In this case, slots may be formed in the sides of the members to facilitate union of the hollow member and the members with the protrusions. Alternatively, the protrusions may be provided on the hollow member.

The protrusions may be in the form of a threaded fastening with a suitably shaped head, for example cylindrical, the fastening being received in an aperture in a protrusion-bearing member. The fastening may be maintained in position with a lock nut.

The protrusion-bearing members may be received in recesses formed in the rim.

The container may comprise a substantially circular base and side walls formed by a substantially cylindrical member in the form of a tube secured at one end around the circular base and sealed along a substantially straight line at the other end. An opening may be incorporated in, for example substantially midway along, the substantially straight line seal and may include an externally threaded spout which is covered by an internally threaded cap provided with an outlet nozzle.

A filter member may bear against the outer end of the spout, while a seal may bear against the inner end of the cap. A removable closure may be provided between the seal and the inner end of the cap when the container is not in use in the line marking apparatus.

The second engaging member may comprise a plurality of, for example two diametrically opposed, substantially L-shaped recesses provided in the region of the base of the container. Alternatively, the second engaging member may be in the form of a plurality of apertures formed in the region of the base of the container.

Alternatively, the first and second engaging members may comprise a plurality of hooks formed on one of the body and the container and a corresponding plurality of loops may be formed on the other of the body and the container. As a further alternative, the interior surface of the body, for example the rim thereof, may be threaded and the external surface of the container may be formed with a substantially rigid externally threaded member in the region of the base thereof.

The number of first and second engaging members may be identical. Alternatively, the number of second engaging members may be a multiple of the number of first engaging members.

A line for conducting the line marking material from the container may be in the form of a coil when not stressed.

BRIEF DESCRIPTION OF THE DRAWINGS

For a better understanding of the present invention and to show more clearly how it may be carried into effect reference will now be made, by way of example, to the accompanying drawings in which.

DESCRIPTION OF PREFERRED EMBODIMENTS

Figure 1:
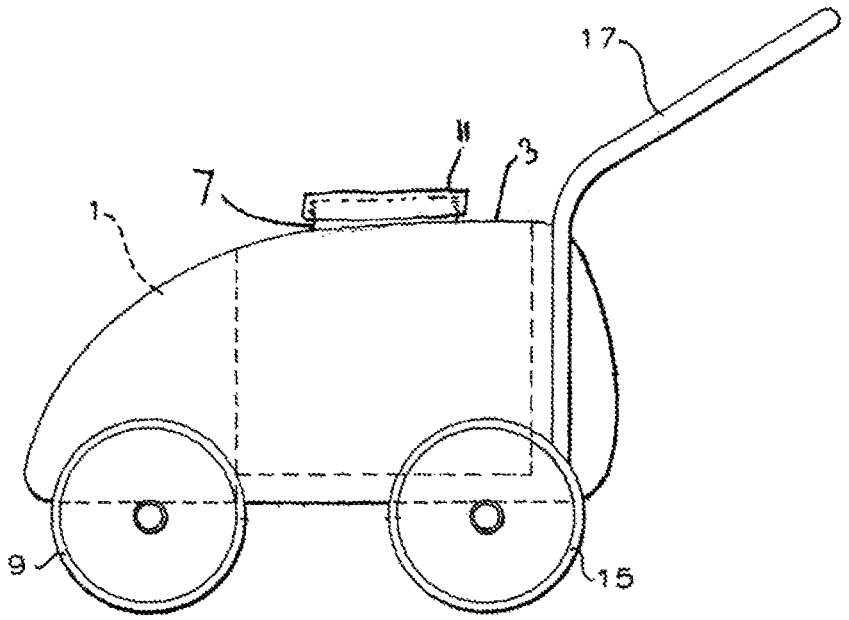
FIG. 1 is a side view of one embodiment of a line marking apparatus according to the present invention.

The line marking apparatus shown in FIGS. 1 to 4 comprises a body including a forward section 1 and a rear section 3. The forward section 1 is provided for housing a battery, a pump and valve. The forward section 1 is constructed as a moulding of plastics or like material incorporating a base, side walls and a sloping top surface, there being provided in the sloping top surface a removable, for example hinged, cover (not shown) to provide access to the components provided within the forward section.

A forward axle is mounted beneath the forward section 1, for example by way of a pair of transverse protrusions formed in the region of each side of the base of the forward section, the forward axle carrying front wheels 9. A line marking head (not shown) may also be mounted beneath the forward section 1 so as to extend forwardly of the body of the line marking apparatus, the line marking head being secured to the base of the forward section 1 by way of an elongate member which is received between a pair of longitudinal protrusions formed in the base of the forward section. If desired, the line marking head may be movable laterally of the forward section, for example as described in WO2006013386. Alternatively, the line marking head may be mounted laterally of the rear section 3 and, if desired, may be movable laterally of the rear section, for example along the lines described in WO2006013386.

A rear axle is mounted beneath the rear section 3, for example by way of a pair of transverse protrusions formed in the region of each side of the line marking apparatus, the rear axle carrying rear wheels 15.

A handle arrangement 17 is provided for propelling the line marking apparatus. The handle arrangement is received in an upright groove formed in each side of the rear section 3 and is inclined rearwardly at a level above the rear section to facilitate propulsion of the apparatus. Switch means (not shown) may be provided on the handle arrangement for controlling operation of the pump.

The rear section 3 is constructed in the same manner as the forward section 1, that is as a moulding of plastics or like material incorporating a base, side walls, a rear wall, and a top surface. The top surface is formed with an outwardly (upwardly) protruding rim 7 which is externally threaded and in turn is provided with a removable cover 11 which can be screwed onto or off the rim 7. If desired, at least the outer surfaces of the forward and rear sections 1, 3 may be formed as a single moulding, with other surfaces being attached, for example by welding or by adhesive, as necessary.

Figure 2:
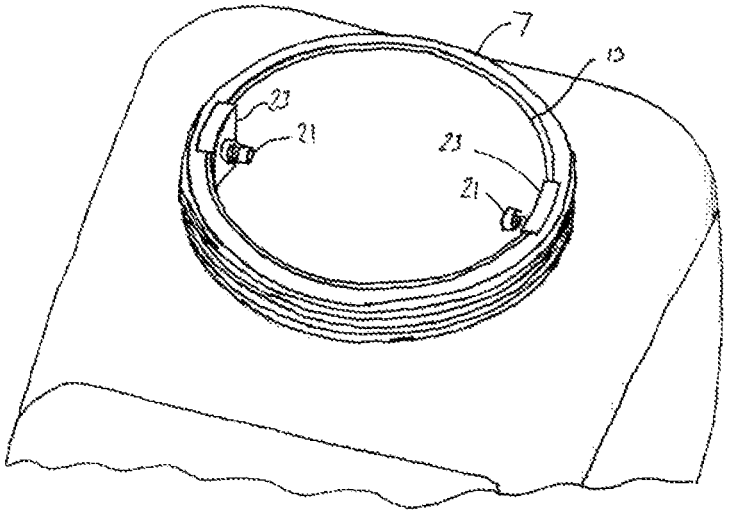
FIG. 2 is a perspective view of part of the line marking apparatus shown in FIG. 1.
Figure 3:
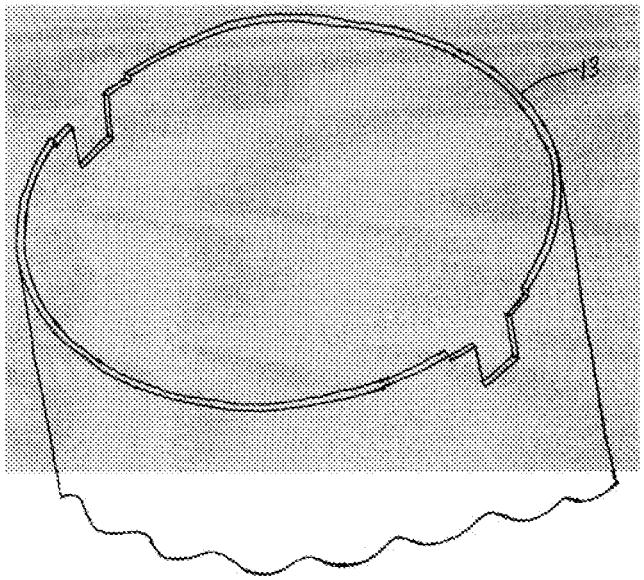
FIG. 3 is a cylindrical insert fitted within the part of the line marking apparatus shown in FIG. 2.
Figure 4:
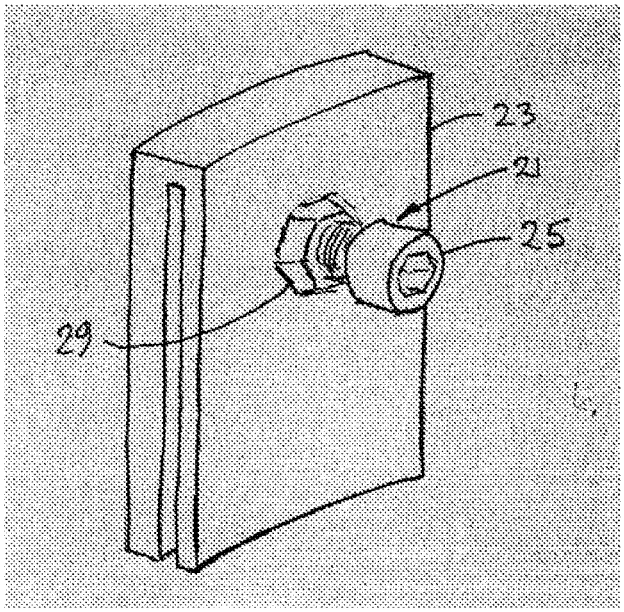
FIG. 4 shows a mounting member for the insertion of protrusions as shown in FIG. 2 in the cylindrical insert of FIG. 3.

As can be seen from FIGS. 2 and 3, a substantially cylindrical hollow member 13 is attached within the rim 7 and extends downwardly into the rear section 3 of the body. A pair of diametrically opposed protrusions 21 extend radially inwardly from the cylindrical member 13, the purpose of which will be explained in more detail hereinafter. For convenience, as illustrated in FIG. 4, the protrusions 21 may be formed on members 23 which may be slotted into recesses formed in the cylindrical member 13, slots being formed in the sides of the members 23 to facilitate union of the cylindrical member 13 and the members 23 with protrusions 21. The protrusions 21 may be in the form of a threaded fastening 25 with a suitably shaped head, such as cylindrical, the fastening being threaded into a threaded aperture in the member 23 and maintained in position with a lock nut 29 which is tightened against the member 23. Alternatively, a threaded nut (not shown) may be provided on the opposite side of the member 23 to receive the threaded fastening 25. As can be seen from FIG. 2, the members 23 are received in recesses formed in the rim 7 to provide secure anchorage for the members 23. It should be noted the cylindrical member 13 is not essential and can be omitted and the protrusions can be formed directly on the rim 7 of the rear section 3 of the body. Alternatively, the members 23 may be omitted and the protrusions 21 may be provided directly on the cylindrical member 13.

It should be noted that, while the member 13 is described as being cylindrical, other shapes are also possible, such as an oval or polygonal cross-sectional shape. Also, although two protrusions 21 are described, a different number of protrusions can be provided, such as three.

Figure 5:
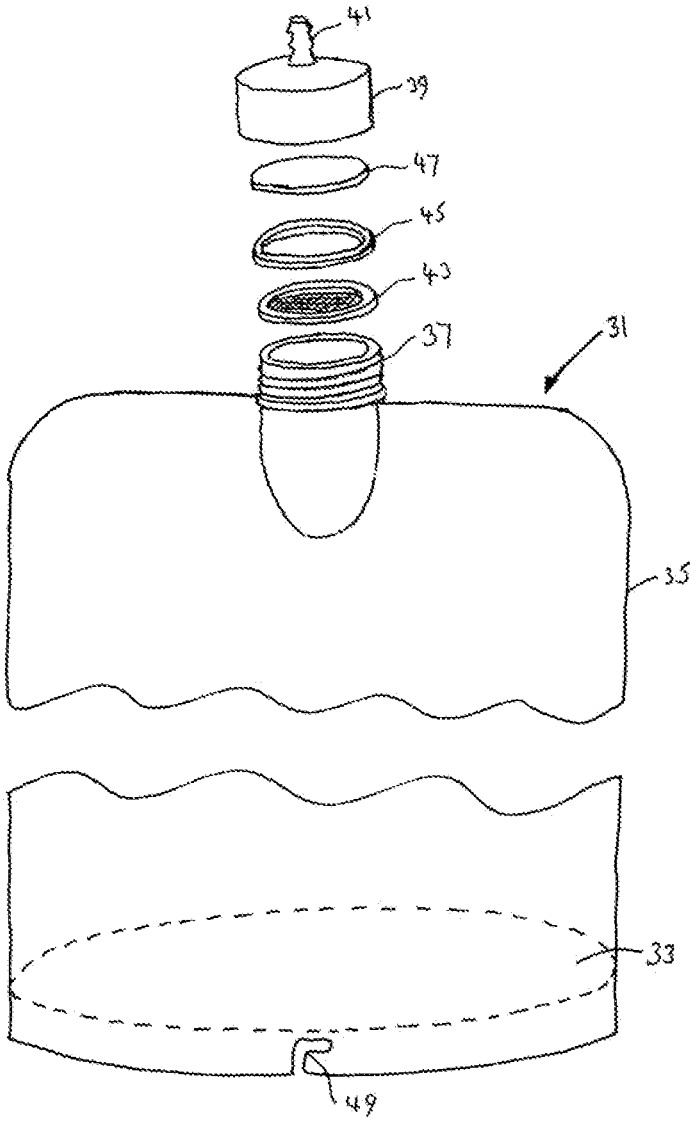
FIG. 5 is an exploded perspective view of a line marking material container for use with the line marking apparatus.

FIG. 5 shows a line marking material container 31 for use with the rear section 3 of the line marking apparatus. The container 31 comprises a substantially circular base 33 and side walls formed by a substantially cylindrical member 35 in the form of a tube secured at one end around the circular base and sealed along a substantially straight line at the other end. An opening is incorporated substantially midway along the substantially straight line seal and includes a substantially circular externally threaded spout 37 which is covered by an internally threaded cap 39 provided with an outlet nozzle 41. As illustrated in FIG. 5, a filter member 43 bears against the outer end of the spout 37, while a seal 45 bears against a removable closure 47 which, in turn, bears against the inner end of the cap 39. The free end of the container 31 in the region of the circular base 33 is provided in its peripheral region with a pair of diametrically opposed substantially L-shaped recesses 49. In practice, the number and location of recesses 49 should match the number and location of the protrusions 21 or should be a multiple thereof (such as two protrusions and four recesses). Moreover, the recesses 49 may alternatively be in the form of apertures formed through the region of the base 33.

It should be noted that the protrusions 21 and recesses 49 are not in themselves essential and can be replaced by alternative means for suspending the container in an inverted configuration within the opening of the rim 7. For example, a plurality of hooks may be formed on one of the members and a corresponding plurality of loops may be formed on the other of the members. As a further example, the interior surface of the rim may be threaded and the external surface of the free end of the container may be formed with a substantially rigid externally threaded member such that the rim and the container can be rotated relative to each other to give rise to inter-engagement and support for the container in an inverted configuration.

In use of the container 31 with the cap 39 uppermost, the cap 39 is unscrewed, closure 47 is removed, cap 39 is replaced and the outlet nozzle 41 is connected to a line for conducting the line marking material and positioned within the rear section 3 with the cap 39 lowermost. The container 31 is then lowered into the cylindrical member 13 and the axial components of the L-shaped recesses 49 engage the protrusions 21 and when fully inserted the container is rotated about its axis to move the protrusions along the peripheral directed portions of the L-shaped recesses 49 to maintain the container 31 within the cylindrical member 13. The cover 11 can then be applied to the rim 7. The line for conducting the line marking material to the pump therefore needs to be of sufficient length to attach to the container 31 while the container is upright, for example beside the line marking apparatus, and while the container is inverted and being inserted into the cylindrical member 13. It has been found that a line which is made so as to form into a coil when not stressed is particularly useful.

The containers 31 can be stored in a configuration in which they are supported on their circular bases 33, while in use in the line marking apparatus the containers are inverted with the base 33 uppermost. This has the advantage that line marking material flows downwardly through the container 31 to the outlet nozzle 41, rather than being drawn upwardly out of the container, with the result that the container 31 is more reliably emptied of line marking material and that no line marking material is wasted. Further, downward flow of the line marking material provides a gravity feed to the pump, assists in priming the pump and reduces the risks of air locks. Additionally, there tends to be some settlement of the solid constituents of the line marking material over time, while the containers are stored, and inverting the container when it is inserted into the cylindrical member 13 tends to re-distribute the solid constituents of the line marking material throughout the material. Moreover, the use of a sealed bag reduces the likelihood of the line marking material becoming contaminated and the likelihood of bacterial growth in the line marking material. Also, the risk of dried flakes of line marking material falling from the sides of the container is significantly reduced.

The invention claimed is:

1. A line marking apparatus incorporating a replaceable container of line marking material, the apparatus being propellable over a ground surface and comprising:

a body (3) having a line marking head arranged for applying line marking material to the ground surface, the body including an opening provided with a first engaging member (21); and a replaceable container (31) for the line marking material, the container comprising a base (33) and side walls (35), the container being provided with an outlet (37) for the line marking material at a location remote from the base, wherein the container is provided in the region of the base with a second engaging member (49) adapted to co-operate with the first engaging member of the body for releasably suspending the container within the body in an inverted configuration.

2. A line marking apparatus as claimed in claim 1, wherein the body (3) is formed with an outwardly protruding rim (7) which is externally threaded and provided with a removable cover (11).

3. A line marking apparatus as claimed in claim 2, wherein the interior surface of the body is threaded and the external surface of the container is formed with a substantially rigid externally threaded member in the region of the base thereof.

4. A line marking apparatus as claimed in claim 3, wherein the interior surface of the rim is threaded.

5. A line marking apparatus as claimed in claim 2, wherein a hollow member (13) is attached within the rim (7) so as to extend into the body (3).

6. A line marking apparatus as claimed in claim 5, wherein the first engaging member (21) comprises a plurality of protrusions which extend radially inwardly from the body (3).

7. A line marking apparatus as claimed in claim 6, wherein the first engaging member (21) comprises two diametrically opposed protrusions.

8. A line marking apparatus as claimed in claim 6, wherein the protrusions (21) are provided on the hollow member (13).

9. A line marking apparatus as claimed in claim 6, wherein the protrusions (21) are formed on members (23) which are slotted into recesses formed in the hollow member (13).

10. A line marking apparatus as claimed in claim 9, wherein slots are formed in the sides of the members (23) to facilitate union of the hollow member (13) and the members with the protrusions (21).

11. A line marking apparatus as claimed in claim 1, wherein the container (31) comprises a substantially circular base (33) and side walls (35) formed by a substantially cylindrical member in the form of a tube secured at one end around the circular base and closed at the other end with a substantially straight line seal.

12. A line marking apparatus as claimed in claim 11, wherein an opening is incorporated in the substantially straight line seal and includes an externally threaded spout (37) which is covered by an internally threaded cap (39) provided with an outlet nozzle (41).

13. A line marking apparatus as claimed in claim 12, wherein a filter member (43) bears against the outer end of the spout (37).

14. A line marking apparatus as claimed in claim 12, wherein a second seal (45) bears against the inner end of the cap (39).

15. A line marking apparatus as claimed in claim 14, wherein a removable closure (47) is provided between the second seal (45) and the inner end of the cap (39) when the container (31) is not in use in the line marking apparatus.

16. A line marking apparatus as claimed in claim 1, wherein the second engaging member (49) comprises a plurality of substantially L-shaped recesses provided in the region of the base of the container (31).

17. A line marking apparatus as claimed in claim 16, wherein two diametrically opposed substantially L-shaped recesses (49) are provided.

18. A line marking apparatus as claimed in claim 1, wherein the second engaging member (49) is in the form of a plurality of apertures formed in the region of the base of the container (31).

19. A line marking apparatus as claimed in claim 1, wherein the first and second engaging members (21, 49) comprise a plurality of hooks formed on one of the body (3) and the container (31) and a corresponding plurality of loops formed on the other of the body and the container.

20. A line marking apparatus as claimed in claim 1, wherein a line for conducting the line marking material from the container (31) is in the form of a coil when not stressed.

* * * * *